US006321703B1

(12) United States Patent
Diehl et al.

(10) Patent No.: US 6,321,703 B1
(45) Date of Patent: Nov. 27, 2001

(54) DEVICE FOR CONTROLLING A GAS EXCHANGE VALVE FOR INTERNAL COMBUSTION ENGINES

(75) Inventors: Udo Diehl, Stuttgart; Karsten Mischker, Leonberg; Rainer Walter, Pleidelsheim; Stefan Franzl, Grosshelfendorf; Volker Beuche, Stuttgart; Stefan Reimer, Markgroeningen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/485,543

(22) Filed: Feb. 14, 2000

(30) Foreign Application Priority Data

Jun. 12, 1998 (DE) ..... 198 26 047

(51) Int. Cl.[7] ..... F01L 9/02
(52) U.S. Cl. ..... 123/90.12
(58) Field of Search ..... 123/90.12, 90.13, 123/90.15

(56) References Cited

U.S. PATENT DOCUMENTS 4,009,695 * 3/1977 Ule ..... 123/90.13
4,930,464 * 6/1990 Letsche ..... 123/90.12
4,930,465 * 6/1990 Wakeman et al. ..... 123/90.12
5,572,961 * 11/1996 Schechter et al. ..... 123/90.12

FOREIGN PATENT DOCUMENTS 05-202712 * 8/1993 (JP) .
96/12109 * 4/1996 (WO) .

* cited by examiner

*Primary Examiner*—Weilun Lo
(74) *Attorney, Agent, or Firm*—Ronald E. Greigg

(57) ABSTRACT

A device for controlling a gas exchange valve for internal combustion engines, having a housing including an axially movable valve member, which on an end close to the combustion chamber, has a valve sealing face that cooperates with a valve seat affixed to the housing and on an end remote from the combustion chamber, has a piston that axially separates upper and lower hydraulic working chambers from each other. The lower working chamber closer to the combustion chamber acts on the valve member in the closing direction and the upper working chamber further from the combustion chamber acts on the valve member in the opening direction. The lower working chamber continuously communicates with a high pressure source and the upper working chamber can be alternatingly filled with high pressure by way of a high pressure supply line containing an electric control valve. The upper working chamber is discharged by way of a discharge line that contains an electric control valve. When the electric control valve is without current, the control valve closes the high pressure supply line connected with the upper working chamber and when the electric valve in the discharge line is without current, the discharge line is open.

4 Claims, 1 Drawing Sheet

DEVICE FOR CONTROLLING A GAS EXCHANGE VALVE FOR INTERNAL COMBUSTION ENGINES

PRIOR ART

The invention is based on device for controlling a gas exchange valve for internal combustion engines as set forth here in after. In a control device of this kind, which has been disclosed by DE 195 11 320, a piston-shaped valve member is guided so that the valve member can be axially moved in a housing, wherein on an end close to the combustion chamber, the valve member has a disk-shaped valve sealing face which cooperates with a valve seat fixed to the housing, in order to control an inlet or outlet cross section on the combustion chamber of the engine to be fed. On a shaft end remote from the combustion chamber, the valve member has a hydraulic piston which axially separates two hydraulic working chambers from each other. The lower working chamber closer to the combustion chamber acts on the valve member of the gas exchange valve in the closing direction and an upper working chamber further from the combustion chamber acts on the valve member in the opening direction. In this connection, the lower working chamber continuously communicates with a high pressure source by way of a high pressure supply line and is consequently acted on with high pressure. The upper working chamber can be alternatingly filled with high pressure by way of a high pressure supply line containing an electric control valve and discharged by way of a discharge line that contains another electric control valve. The gas exchange valve is then actuated by means of the controlled filling of the upper working chamber. When the control valve in the high pressure supply line is open, a highly pressurized pressure fluid flows into the upper working chamber. The pressure engagement area on the piston of the valve member of the gas exchange valve is greater than the pressure engagement area in the lower working chamber so that the piston and the valve member together are moved downward in the opening direction and thus open the opening cross section at the valve member seat. The discharge line of the upper working chamber is closed in the meantime by the second control valve. Through the deliberate opening of the control valves in the high pressure supply line and the discharge line at the upper working chamber of the gas exchange valve member, it is then possible to produce different opening positions and to move the gas exchange valve member back onto its valve seat again by opening the control valve in the discharge line.

The known control device for gas exchange valves, however, has the disadvantage that in the event of a failure of the pressure supply system, the valve member can remain in its open valve member position so that there is the danger of the gas exchange valve member colliding with the piston of the engine in the top dead center of this piston. This can lead to the jamming of the entire valve assembly and to extremely serious mechanical damage to the engine itself and also jeopardizes the safety of the vehicle passengers due to the possible locking of the drive axles in the driven vehicle.

ADVANTAGES OF THE INVENTION

The device according to the invention for controlling a gas exchange valve for internal combustion engines has an advantage over the prior art that a hydraulically actuatable valve adjuster concept is produced which, even in the event of a failure of the pressure supply device or the electrical triggering of the control valves, reliably prevents the gas exchange valve member from jamming in the open position and assures a return of the valve member to its closed position. According to the invention, three safety measures that are independent of one another are proposed, which can be realized individually, but for safety reasons, only represent an optimal safety concept when they are used together.

A first measure is realized according to the invention by virtue of the fact that the electric control valves, which are disposed in the high pressure supply line and in the discharge line of the upper working chamber that produces the opening movement of the gas exchange valve member, are switched into the currentless state so that the upper working chamber against the piston of the gas exchange valve member is pressure relieved. When the lower working chamber, which acts on the gas exchange valve member in the closing direction, is continuously connected to the high pressure supply line, it is consequently assured that the valve member is held securely in contact with the valve seat when the control valves are without current. The hydraulic working chamber responsible for the opening stroke motion of the gas exchange valve member can be filled with high pressure only when the electric control valves are supplied with current so that the gas exchange valve can only be triggered when the on-off valves are functioning perfectly. When there are electrical problems, for example in the event of a cable deterioration with regard to the actuator, short circuits in the control lines, etc., it is sufficient to switch the control valves or their triggering devices into the currentless state. It is particularly advantageous that two independent actions are required to move the gas exchange valve member into the critical open position, namely the active closing of the electric control valve in the discharge line and the opening of the electric control valve in the high pressure supply line. Since the working chamber responsible for the closing motion of the valve member of the gas exchange valve continuously communicates with the high pressure supply line, there is no electric component that can fail in the path responsible for the closing.

The electric control valves are advantageously embodied as solenoid valves, which are triggered by an electric control unit as a function of operating parameters of the engine to be fed.

Another possibility according to the invention for moving the gas exchange valve member into its closed position in the event of a failure of the control device is achieved through the provision of an emergency reservoir that is connected directly to the lower hydraulic working chamber responsible for the closing motion. This emergency reservoir, which is preferably embodied as a spring reservoir, only stores the volume of high pressure fluid required to move the gas exchange valve member into its closed position. The valve control device can also be provided with another working chamber, which is likewise preferably embodied as a spring pressure reservoir and is particularly used to maintain a preset standing pressure in the control device. This working pressure reservoir is preferably intended to compensate for a possible leakage loss during the shutting off of the engine to be fed and also to maintain a standing pressure which assures a reliable function of the control device immediately with the beginning of the operation of the engine. Furthermore, the working pressure reservoir produces a smoothing of the pressure fluctuations in the system during operation so that the working pressure reservoir requires a stronger restoring moment than the emergency reservoir and therefore has a higher spring force than the emergency reservoir so that the two spring reservoirs operate at different pressure levels.

In order to prevent a drainage of reservoir pressure in the high pressure supply of the control device, a check valve is also provided in a high pressure supply line from a pressure supply device. The valve opens in the direction of the gas exchange valve member and is followed in the flow direction by the pressure reservoir and a branch line into the lower working chamber.

Another check valve is advantageously inserted into the discharge line.

Another measure for reliably restoring and holding the gas exchange valve member in the non-critical closed position is achieved through the provision of a mechanically acting restoring element, preferably an emergency spring on the gas exchange valve member. In the event of a failure of the entire pressure supply system and a pressure drop as well in the hydraulic working chambers against the piston of the valve member, this valve member is returned into its closed position. This emergency spring is preferably embodied as a compression spring which is inserted into the lower hydraulic working chamber responsible for the closing motion of the valve member and engages with the valve member piston there in the closing direction. The spring is dimensioned precisely so that under all circumstances, it can overcome the friction forces in the actuator and can move the gas exchange valve member piston from any position into the secure, closed position.

The proposed control system for a gas exchange valve for internal combustion engines consequently assures that even in the event of a failure of the control system, the gas exchange valve member is reliably returned to its closed position so that a collision of the gas exchange valve member with the piston of the engine can be reliably prevented.

Other advantages and advantageous embodiments of the subject of the invention can be inferred from the specification, the claims, and the drawing.

BRIEF DESCRIPTION OF THE DRAWING

An exemplary embodiment of the device according to the invention for controlling a gas exchange valve for internal combustion engines is shown in the drawing and will be explained in detail in the description that follows.

The sole FIGURE shows a schematic depiction of an exemplary embodiment of the control device in which, in addition to the working pressure reservoir, an emergency pressure reservoir is also connected to the lower working chamber of the adjusting piston, and in which consequently all of the proposed safety devices are shown.

DESCRIPTION OF THE EXEMPLARY EMBODIMENT

Figure 1:
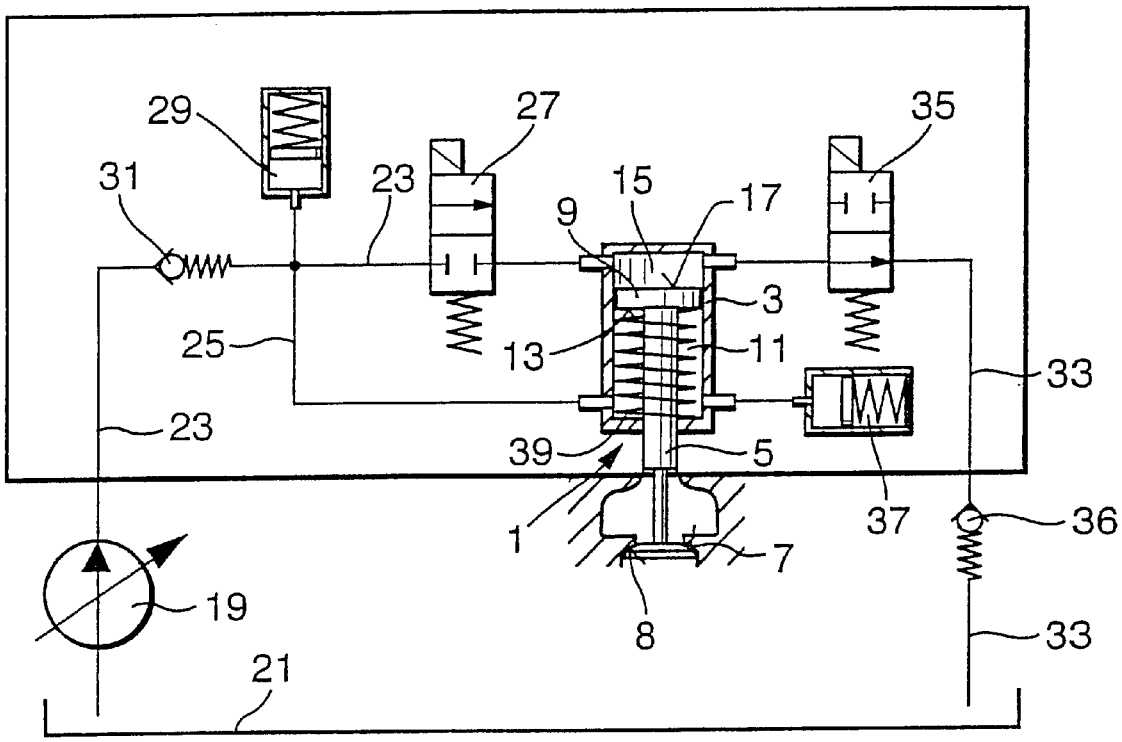

The device schematically depicted in FIG. 1 for controlling a gas exchange valve for internal combustion engines has a gas exchange valve 1 for controlling an inlet or outlet cross section on the combustion chamber of an engine, not shown in detail. The gas exchange valve 1 has a valve member 5 which can be axially moved in a housing 3 and on a lower disk-shaped end oriented toward the combustion chamber, has a valve sealing face 7 which is used to cooperate with a valve seat face 8 on the housing of the engine in order to control an opening cross section. On an upper end remote from the combustion chamber, the valve member 5 has a cross sectional enlargement that forms a piston 9, with which the valve member 5 axially separates two hydraulic working chambers from one another in the housing 3. A lower hydraulic working chamber 11 that is closer to the combustion chamber acts on the valve member S on a lower piston ring end face 13, in the closing direction of the gas exchange valve 1. An upper working chamber 15 further away from the combustion chamber acts on the valve member 5, which opens toward the bottom, in the opening direction, wherein the pressure in the upper working chamber 15 engages the entire upper piston end face 17.

In order to supply pressure to the control device in the form of a highly pressurized pressure fluid, a pressure supply device is also provided, which in the exemplary embodiment is constituted by a regulated high pressure pump 19, which feeds the pressure fluid, for example oil, from a reservoir 21 into a high pressure supply line 23. The high pressure pump 19 can be regulated on the suction side or on the pressure side. Alternatively, it is also possible to use a pressure reservoir as a high pressure fluid source from which a number of high pressure supply lines then lead to the individual control devices of the individual gas exchange valves.

A branch line 25 branches off from the high pressure supply line 23 at the control device and feeds into the lower hydraulic working chamber 11. The original part of the high pressure supply line 23 feeds into the upper hydraulic working chamber 15. A first control valve 27 is inserted into the high pressure supply line 23 between where it branches into the branch line 25 and where it feeds into the upper working chamber 15. Furthermore, a working pressure reservoir 29 is connected with the high pressure supply line 23 upstream of the first control valve 27 in the flow direction and is used as a spring pressure reservoir. In order to assure a preset standing pressure in the high pressure supply line 23 and in the branch line 25 connected to the high pressure supply line 23, and in order to prevent the escape of pressure fluid from these lines in the event of damage, a check valve 31 is also inserted into the high pressure supply line 23 upstream in the flow direction from the split into the branch line 25, the working pressure reservoir 29, and the first control valve 27.

Furthermore, a discharge line 33 leads from the upper working chamber 15, feeds into the reservoir 21, and has a second electric control valve 35 inserted into the line 33, which can close the discharge line 33. In order to prevent the line 33 and the upper working chamber 15 from being drained, a check valve 36 that opens in the direction of the reservoir 21 is also inserted into the discharge line 33.

In order to assure a reliable return of the valve member 5 of the gas exchange valve 1 to its valve seat 8 fixed to the housing, even in the event of a pressure drop in the high pressure line system, the lower working chamber 11 is also connected to an emergency pressure reservoir 37. This emergency pressure reservoir 37, which is embodied as a spring pressure reservoir, is dimensioned so that after the detection threshold for the decrease of the supply pressure is reached, and including the closing losses of the check valve 31, there is still enough pressure and volume remaining for the closing process of the actuator in the pressure reservoir. As a result, the function of the emergency pressure reservoir 37 can be integrated into the control device according to the invention in addition to the working pressure reservoir 29; alternatively, however, it is also possible to perform the emergency pressure reservoir function with the working pressure reservoir 29 or to provide the control system with only the emergency pressure reservoir 37.

When the working pressure reservoir 29 and the emergency pressure reservoir 37 are provided in tandem, the working pressure reservoir 29 and the emergency pressure reservoir 37 function at different pressure levels, wherein the working pressure reservoir 29 functions with a higher restoring moment at a higher pressure level. In addition to containing the residual pressure, the working pressure reservoir 29 also takes on the task of smoothing out the working pressure so that undesirable pressure fluctuations in the system can be compensated for. The different pressure levels in the spring reservoirs of the two pressure reservoirs 29, 37 are thereby set by means of different restoring springs, wherein the spring of the emergency pressure reservoir 37 has the lower spring force.

In order to keep the valve member 5 of the gas exchange valve 1 in the closed position after a complete pressure relief of the pressure system by means of a slight leakage, for example when the engine to be fed is shut off for a long period of time in which the pressure reservoirs 29 and 37 are also emptied, an emergency closing spring 39 is also inserted into the lower working chamber 11.

This emergency closing spring 39 is embodied as a compression spring, which is clamped between a lower housing shoulder and the lower piston ring end face 13, and consequently acts on the valve member 5 of the gas exchange valve 1 in the closing direction. This emergency spring 39 is dimensioned to be just strong enough that under all circumstances, it can overcome the friction moments in the gas exchange valve and can move the piston 9 on the valve member 5 from any actuator position into the closed position.

The device according to the invention for controlling a gas exchange valve of an internal combustion engine functions in the following manner. With the beginning of the operation of the internal combustion engine, the high pressure pump 19 driven by this engine supplies a pressure fluid, preferably highly pressurized oil, into the high pressure supply line 23. This high pressure travels by way of the check valve 31 and the continuously open branch line 25 into the lower hydraulic working chamber 11, which holds the valve member 5 in its upwardly directed closed position by way of the lower piston ring end face 13. In the rest position or closed position of the gas exchange valve 1, the electric control valves 27 and 35 are switched without current, wherein the first control valve 27 thereby closes the high pressure supply line 23 into the upper working chamber 15. The second control valve 35 is switched open when it is without current so that the discharge line 33 leading from the upper working chamber 15 into the pressure fluid reservoir 21 is open. In this manner, the valve member 5 is pressed against its valve seat 8 by the pressure in the lower working chamber 11. Only atmospheric pressure prevails in the upper pressure chamber 15. In order to then open the gas exchange valve 1, the first control valve 27 in the high pressure supply line 23 is supplied with current and is consequently opened, while the second control valve 35 is closed by being supplied with current. As a result, the pressure fluid then flows into the upper working chamber 15. Since the upper pushing area 17 of the piston 9 is greater than the lower pushing area 13 and the pressure in the two working chambers 15, 11 is virtually the same, the resulting compressive force then moves the valve member 5 of the gas exchange valve 1 downward into its open position. The opening cross section of the gas exchange valve is opened by means of the lifting of the valve sealing face 7 from the valve seat 8 on the housing. In order to fix the gas exchange valve member 5 in a particular open position, the control valve 27 is closed and as a result, the supply of pressure fluid into the upper working chamber 15 is interrupted. The gas exchange valve member 5 consequently comes to a stop if the resulting force of the pressure forces in the working chambers 11 and 15 in cooperation with the restoring forces on the valve member 5 is zero. As a result, depending on operating parameters of the engine, any valve opening position can be set by means of an electric control device through the deliberate triggering of the control valves 27 and 35, which are preferably embodied as solenoid valves.

In order to close the gas exchange valve 1 again, when the first control valve 27 is also closed, the second control valve 35 in the discharge line 33 is opened. As a result, the pressure in the upper working chamber 15 is reduced almost to the atmospheric pressure level, while the high system pressure continues to prevail in the lower working chamber 11. Since the product of pressure and pushing area in the lower working chamber 11 is now greater than in the upper working chamber 15, the piston 9 and consequently the valve member 5 of the gas exchange valve 1 is moved into the closed position again by means of the resulting force and is pressed with the valve sealing face 7 into the valve seat 8. The rest state is consequently reached again and a new work cycle can ensue. In this connection, the pressure fluid high pressure remains in the lower working chamber 11, in the pressure line system downstream of the check valve 31.

The foregoing relates to a preferred exemplary embodiment of the invention, it being understood that other variants and embodiments thereof are possible within the spirit and scope of the invention, the latter being defined by the appended claims.

What is claimed is:

1. A device for controlling a gas exchange valve for internal combustion engines, comprising:

a housing (3), an axially movable valve member (5) in said housing, said valve member (5), on an end close to the combustion chamber, has a valve sealing face (7) that said valve member uses to cooperate with a valve seat (8) affixed to the housing, and on an end remote from the combustion chamber, the valve member includes a piston (9) that axially separates lower and upper hydraulic working chambers (11 and 15) from each other, the lower working chamber (11) closer to the combustion chamber acts on the valve member (5) in a closing direction, and the upper working chamber (15) further from the combustion chamber acts on the valve member (5) in the opening direction, the lower working chamber (11) continuously communicates with a high pressure source (19) and the upper working chamber (15) can be alternatingly filled with high pressure by use of a high pressure supply line (23) that contains an electric control valve (27), and said upper working chamber is discharged by a discharge line (33) that contains an electric control valve (35), wherein, when the electric control valve (27) is without current, the electric control valve (27) closes the high pressure supply line (23) to prevent a flow of fluid into the upper working chamber (15) and when the electric valve (35) is without current, the electric valve (35) keeps the discharge line (33) open, and in which said high pressure source is upstream of said electric control valve (27) and supplies a pressurized hydraulic working medium into the high pressure supply line (23), a branch line (25) leads from said high pressure supply line into the lower working chamber (11), a check valve (31) that opens in a flow direction is inserted into the high pressure supply line (23) upstream of a connection of branch line (25) with said high pressure supply line (23), the high pressure supply line (23) is connected to a working pressure reservoir (29) that is embodied as a spring reservoir, a mechanically acting restoring member in a form of an emergency spring (39), is provided on the gas exchange valve (1), and said restoring member acts on the gas exchange valve member (5) in a direction of a closing motion of the valve member (5), and the emergency spring (39) is embodied as a compression spring, said compression spring is clamped in the lower working chamber (11) between a housing shoulder and the piston (9) on the valve member (5) of the gas exchange valve (1).

2. The device according to claim 1, in which the electric control valves (27, 35) in the high pressure supply line (23) and the discharge line (33) are embodied as solenoid valves that are triggered by an electric control unit as a function of operating parameters of the engine.

3. The device according to claim 1, in which the high pressure source is embodied as a high pressure pump (19) that can be regulated.

4. The device according to claim 1, in which an emergency pressure reservoir (37) that is embodied as a spring reservoir is connected with said lower working chamber (11).

* * * * *

UNITED STATES PATENT AND TRADEMARK OFFICE

CERTIFICATE OF CORRECTION

PATENT NO. : 6,321,703 B1
DATED : November 27, 2001
INVENTOR(S) : Udo Diehl et al.

It is certified that error appears in the above-identified patent and that said Letters Patent is hereby corrected as shown below:

Title page,
Item [22] should read as follows:
-- [22] PCT Filed: February 16, 1999 --
Item [86] should read as follows:
-- [86] PCT No. : PCT/DE99/00427
371 Date : February 14, 2000
102(e) Date : February 14, 2000 --

Signed and Sealed this

Fourteenth Day of May, 2002

*Attest:*

*Attesting Officer*

JAMES E. ROGAN
*Director of the United States Patent and Trademark Office*